United States Patent [19]

Souza

[11] 4,030,152

[45] June 21, 1977

[54] AUTOMATICALLY ADJUSTING BOAT SEAT

[75] Inventor: Anthony J. Souza, Lancaster, Pa.

[73] Assignee: Woodstream Corporation, Lititz, Pa.

[22] Filed: July 12, 1976

[21] Appl. No.: 704,749

[52] U.S. Cl. ..... 9/7; 297/345

[51] Int. Cl.[2] ..... A47C 3/34; B63B 29/04

[58] Field of Search ..... 9/6 R, 6 P, 7; 297/345; 248/407, 408; 114/68

[56] References Cited

UNITED STATES PATENTS

| | | | |
|---|---|---|---|
| 3,642,320 | 2/1972 | Ward | 9/7 |
| 3,736,897 | 6/1973 | Krutz | 9/7 |
| 3,839,757 | 10/1974 | Grimes | 9/7 |

*Primary Examiner*—Trygve M. Blix
*Assistant Examiner*—Stuart M. Goldstein

[57] ABSTRACT

A boat comprising a hull and at least one seat therefor, each seat extending transversely across the hull and being supported by telescoping guide members for movement along a vertical path between a lowered position wherein the seat rests on shoulders defined by portions of the hull, and a raised position wherein the seating surface is approximately at the level of the gunwales, the seat carrying flotation so as to automatically move the same to the raised position in the event of swamping of the boat, with stops associated with the guide members for automatically locking the seat when it reaches the raised position.

11 Claims, 7 Drawing Figures

AUTOMATICALLY ADJUSTING BOAT SEAT

This invention relates to a boat construction and relates more particularly to a small boat or the like having a two position locking seat for level flotation.

Ordinarily, boat seats are fixed in position spanning the sides of a boat hull, with their seating surfaces being spaced below the gunwales to provide the boat with a relatively low center of gravity and, therefore, high stability in use. When a boat of this nature is swamped, the seat, as well as the occupants and anything resting on the seat would be covered by water. If the seat was raised to the level of the gunwales, for example, in ordinary use, the center of gravity would be unnecessarily high and would produce an unstable condition. Yet, having the seat in such a raised position in the event of swamping would minimize water damage to items resting on the seat surface, as well as to the occupants.

It is a primary object of this invention to provide a boat construction having a seat means which normally rest in a lowered position to maintain a low center of gravity, but which is automatically raised to a position approximating the level of the gunwales in the event of swamping of the boat.

A further object of this invention is to provide for a boat construction wherein the seat carries flotation means and is not fixed in its lowered position, but is free to automatically move upwardly in the event of swamping of the boat, with stop means being incorporated to limit the upward movement to a desired level.

A further object of this invention is the provision of a small boat or the like including stringers effective to rigidify the hull, while underlying the floatable seat in its lowered or normal operating osition to give additional support thereto.

Other and further objects reside in the combination of elements, arrangement of parts and features of construction, all as will be described in more detail hereinafter, with reference to the accompanying drawings wherein.

Like reference characters refer to like parts throughout the several view of the drawings.

Figure 1:
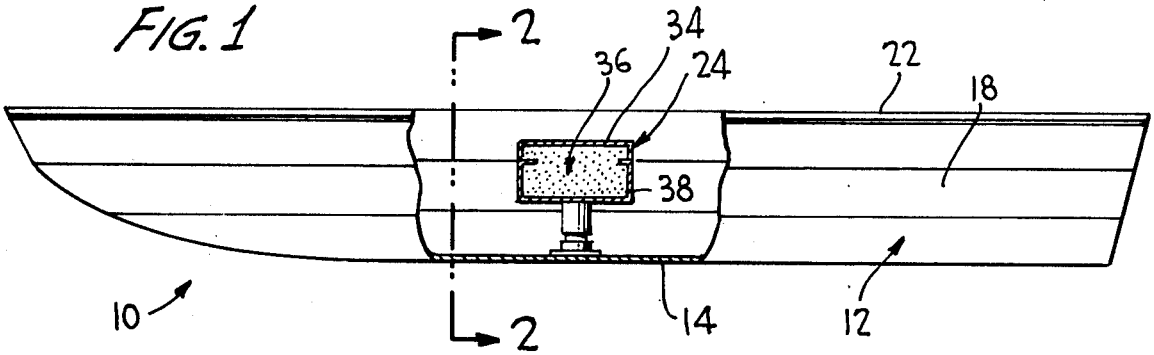
FIG. 1 is a side elevational view of a small boat, with portions broken away and in cross-section for illustrative clarity.
Figure 2:
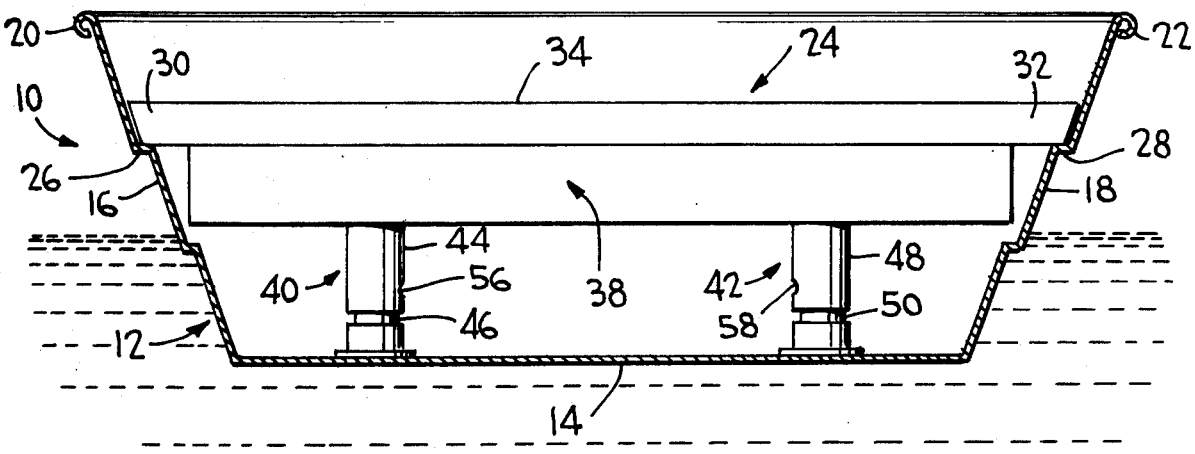
FIG. 2 is an elarged transverse cross-sectional view taken substantially along lines 2—2 of FIG. 1, showing the seat according to one embodiment of the instant inventive concepts in its lowered position.
Figure 3:
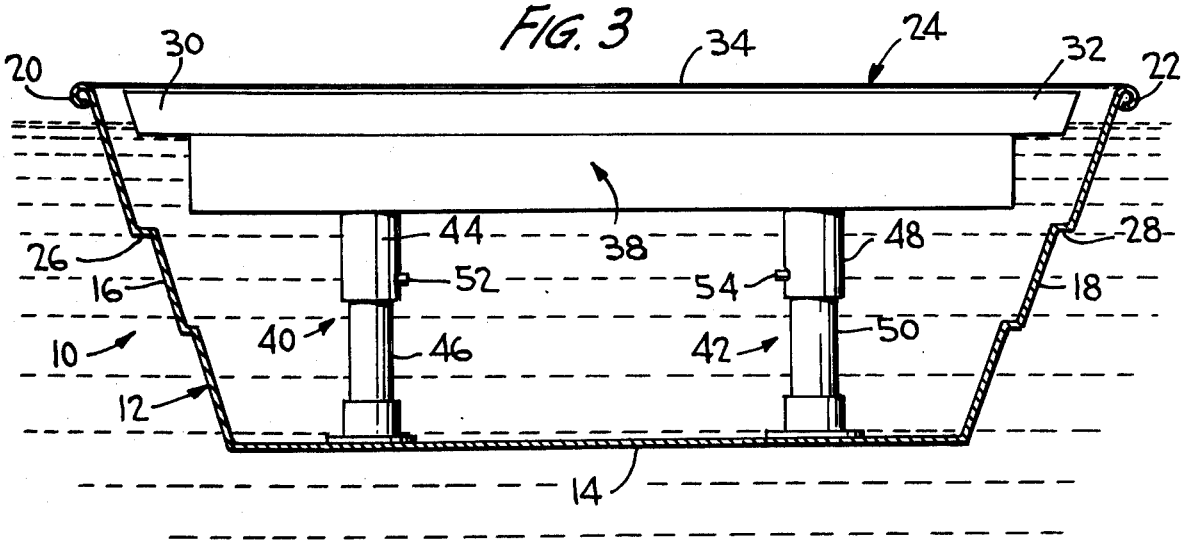
FIG. 3 is a view similar to FIG. 2, but showing the position of the seat when the boat has been swamped.

Referring now to the drawings in general, and more particularly to FIGS. 1–3, one form of boat construction according to the instant inventive concepts is designated generally by the reference numeral 10 and comprises basically hull means 12 including a bottom portion 14 and upwardly extending sides 16, 18 terminating in gunwales 20, 22, and a seat means designated generally by the reference numeral 24.

The hull means 12 can be formed of any conventional material, aluminum being commonly used for small boats of this nature. The gunwales can be merely roll-formed, or if desired an extruded plastic or other separate gunwale member can be secured to the upper edges of the sides as is conventional. Integral shoulders 26, 28 are preferiably formed in the sides 16, 18 of the hull means 12 for a purpose to be described in more detail hereinafter.

While only a single seat means 24 is shown in the drawings for illustrative purposes, it is obvious that more than one longitudinally spaced seat means may be provided. Moreover, the specific design and construction of the seat means may take any of a variety of forms, reference being made to U.S. Pat. No. 3, 916,466 issued Nov. 4, 1975 and showing a number of different seat constructions that could be utilized in a boat according to the instant inventive concepts. In any event, the seat means 24 includes a seat member having opposite end portions 30, 32 and an upper seating surface 34 with flotation mean 36 being carried beneath the seat surface 34 as will be seen particularly in FIG. 1. The flotation means preferably comprises an expanded plastic material such as polystyrene or the like and may be encased by a metallic frame 38 or the like.

In normal use of the boat 10 the opposed end portions 30, 32 of the seat means 24 rest on the shoulders 26, 28 as will be seen particularly in FIG. 2. Guide means 40, 42 are operatively engaged between the hull mean 12 and the seat means 24 to guide the seat means 24 for movement along a vertical path between the lowered position shown in FIG. 2 and the raised position shown in FIG. 3. The guide means preferably take the form of pairs of laterally spaced telescoping guide members 44, 46 and 48, 50, one of each pair, 46, 50, being secured to the bottom portion 14 of the hull means 12, and the other of each pair, 44, 48 being secured to the seat means 24. Further details of securing these elements to the hull means and seat means will be seen by reference to the embodiments of FIGS. 4 and 6.

Stop means in the form of spring pressed stop members 52, 54 carried by the inner telescoping members 46, 50 and corresponding stop openings 56, 58 defined in the outer telescoping members 44, 48 limit the upward movement of the seat means 24 so that the seating surface 34 is approximately at the level of gunwales 20, 22.

The use and operation of the boat construction shown in FIGS. 1–3 will now be obvious. In ordinary use, the opposed end portions 30, 32 of the seat means 24 rest on the shoulders 26, 28 of the sides 16, 18 of the hull means 12. This provides a relatively low center of gravity to the boat 10. However, when the boat is swamped as seen in FIG. 3, the flotation means 36 automatically causes the seat means 24 to move upwardly until the stop members 52, 54 are aligned with the stop openings 56, 58, respectively, to raise the seat means and thereby the occupants of the boat and any item resting on the surface 34 to the position shown in FIG. 3. When the boat has been emptied of water the seat means 24 may again be lowered by pressing the stop members 52, 54 inwardly.

Figure 4:
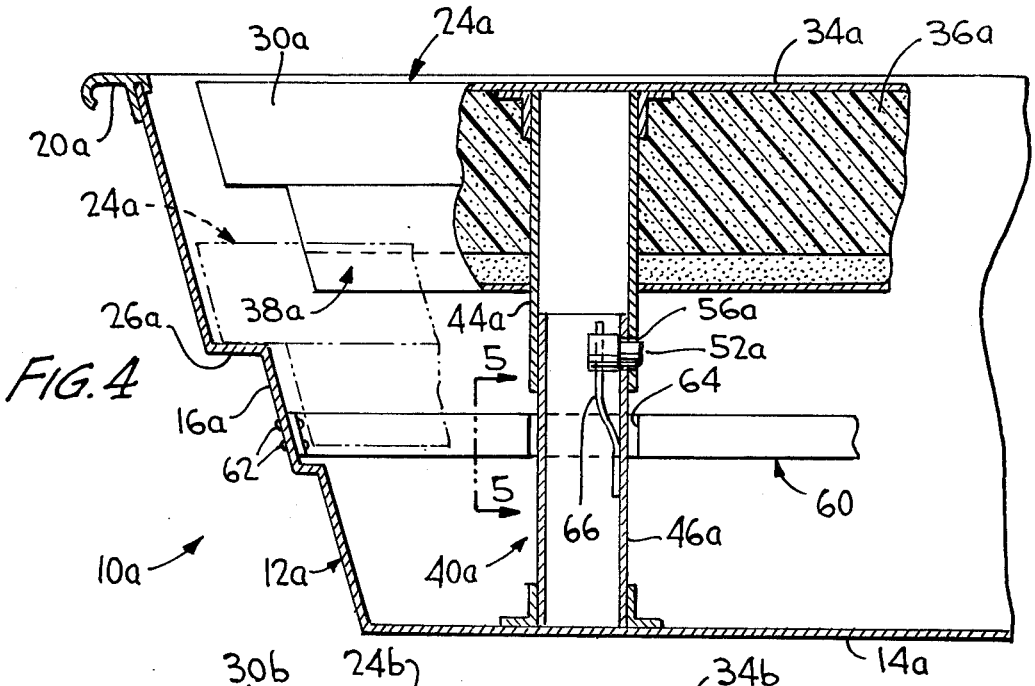
FIG. 4 is a still further enlarged fragmentary cross-sectional view through a portion of a modified boat construction incorporating a stringer means, with portions being broken away for illustrative clarity and with the lowered position of the seat means being shown in dotted lines.
Figure 5:
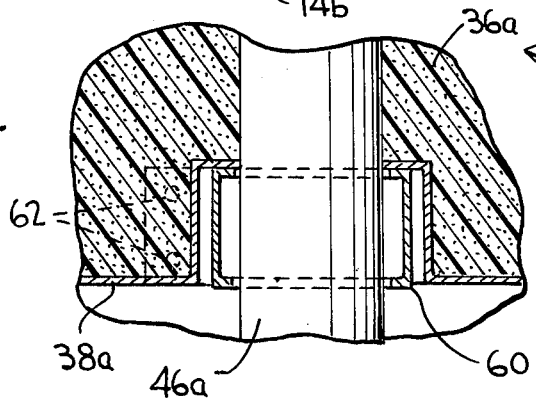
FIG. 5 is a fragmentary detailed view taken substantially along lines 5—5 of FIG. 4.

Reference is now made to FIGS. 4 and 5 wherein a modified embodiment of boat construction according to the instant invention concepts is shown, elements similar to those shown in the embodiment of FIGS. 1–3 being identified by the same reference numeral followed by the suffix *a*. In this embodiment, a stringer means 60 spans the sides of the hull means 12*a* and is secured thereto as by rivets 62 to rigidify the hull construction. Openings such as shown at 64 are provided in the stringer means 60 for passage of the guide means 40*a* therethrough. As will be seen particularly in FIG. 5, the flotation means 36*a* are recessed and rest on the stringer means 60 in the lowered position of the seat means 24*a* to provide additional support for the seat means. The use of a leaf spring means 66 is seen in FIG. 4 to urge the stop member 52*a* radially outwardly until it engages through the stop opening 56*a*.

Figure 6:
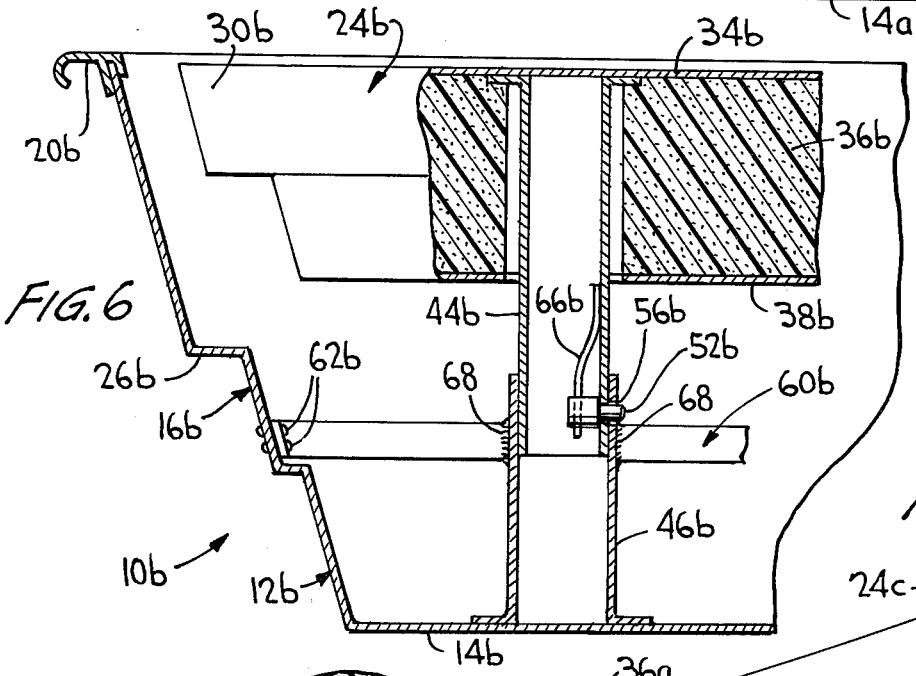
FIG. 6 is a view similar to FIG. 4 wherein the telescoping guide means have been reversed.

In FIG. 6, an embodiment similar to the previous Figures is shown with like reference numerals being designated by the same number followed by the suffix *b*. The basic distinction between this embodiment and the embodiment of FIGS. 4 and 5 is reversal of the telescoping members such that the telescoping member 44*b* secured to the seat means 24*b* rides interiorly of the telescoping member 46*b* secured to the bottom portion 14*b* of the hull means 12*b*. Thus, in this embodiment, the stop member 52*b* is secured as by leaf spring means 66*b* to the member 44*b*, with the stop opening 56*b* being defined in the outer telescoping member 46*b*. With a construction of this type, the stringer means 60*b* can be secured as by welding or the like shown at 68 to the outer telescoping member 46*b* to further increase the structural stability of the various elements.

Figure 7:
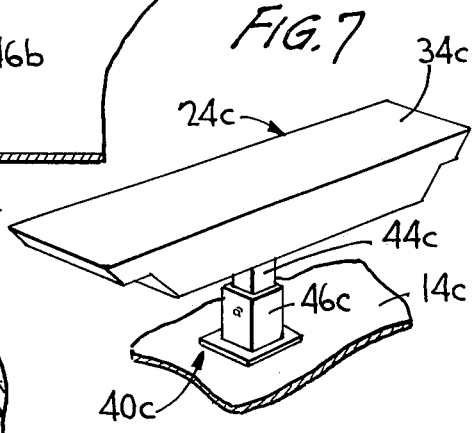
FIG. 7 is a schematic perspective view of a modified embodiment of seat means according to the instant inventive concepts.

In the embodiment of FIG. 7, a still further modification is shown wherein like reference characters are designated by the same reference numeral followed by the suffix *c*. In this embodiment, a single guide means 40*c* is provided with the telescoping members 44*c* and 46*c* being square in cross-section to preclude rotation of the seat means 24*c* in operation. The use of a pair of laterally spaced guide means as shown in the previous embodiments is preferred for improved stability, although an embodiment such as shown in FIG. 7 will be functionally operative.

It is now believed that there is herein disclosed a small boat construction which satisfies all of the objectives of the instant inventive concepts set forth above, and others, including many advantages of great practical utility and commercial importance.

The embodiments of the invention in which an exclusive property or privilege is claimed are defined as follows:

1. A boat construction comprising hull means and seat means therefor, guide means operatively engaged between said hull means and said seat means to guide said seat means for movement along a vertical path between a lowered position and a raised position, support means for supporting said seat means in said lowered position during normal use of the boat, flotation means carried by said seat means for automatically raising said seat means in the event of swamping of the boat, and stop means limiting the upward movement of said seat means to said raised position.

2. The boat construction of claim 1 wherein said hull means includes a bottom portion and upwardly extending sides terminating in gunwales, said seat means including at least one seat member having opposite end portions and an upper seating surface, said seat member extending transversely across said hull means between said sides thereof.

3. The boat construction of claim 2 wherein said flotation means are carried beneath said seating surface of said seat member.

4. The boat construction of claim 2 wherein said support means are defined by a shoulder formed on each side of said hull means below said gunwale, said end portions of said seat member resting on said shoulders during normal use of the boat.

5. The boat construction of claim 2 wherein said guide means includes at least one pair of telescopingly engaged guide members for each seat member, one of said guide members of each pair being fixedly secured to said seat means and the other of said guide members of each pair being fixedly secured to said bottom portion of said hull means.

6. The boat construction of claim 5 including at least two laterally spaced pairs of telescopingly engaged guide members for each seat member.

7. The boat construction of claim 5 wherein each of said pairs of telescopingly engaged guide members includes an outer guide member and an inner member slidable within said outer guide member, said stop means comprising at least one stop opening defined in said outer guide member, a stop member carried by said inner guide member for each stop opening, and resilient means normally biasing each stop member radially outwardly toward the inner surface of said outer guide member, whereby each stop member is biased into stopping engagement with its associated stop opening when said stop member and said stop opening are aligned by movement of said seat means to said raised position.

8. The boat construction of claim 2 wherein said seating surface of said seat member is generally at the level of said gunwales in said raised position.

9. The boat construction of claim 2 further including stringer means extending transversely across said hull means between said sides thereof and beneath said seating surface of said seat member said stringer means having opposite end portions secured to said sides of said hull means to reinforce said hull means.

10. The boat construction of claim 9 wherein said guide means passes through said stringer means.

11. The boat construction of claim 9 wherein said flotation means comprises expanded foam flotation material secured to said seat member below said seating surface thereof, portions of said flotation means being recessed and resting on said stringer means in said lowered position.

* * * * *